US011311103B1

(12) United States Patent
Wilson et al.

(10) Patent No.: US 11,311,103 B1
(45) Date of Patent: Apr. 26, 2022

(54) POOLSIDE TABLE APPARATUS

(71) Applicants: Alexander Wilson, Olathe, KS (US); Virginia Wilson, Olathe, KS (US)

(72) Inventors: Alexander Wilson, Olathe, KS (US); Virginia Wilson, Olathe, KS (US)

( * ) Notice: Subject to any disclaimer, the term of this patent is extended or adjusted under 35 U.S.C. 154(b) by 0 days.

(21) Appl. No.: 17/203,810

(22) Filed: Mar. 17, 2021

(51) Int. Cl.
*A47B 37/04* (2006.01)
*A47B 9/00* (2006.01)
*A47B 13/16* (2006.01)

(52) U.S. Cl.
CPC ..... *A47B 37/04* (2013.01); *A47B 9/00* (2013.01); *A47B 13/16* (2013.01)

(58) Field of Classification Search
CPC ..... A47B 13/16; A47B 2200/03; A47B 5/00; A47B 5/06; D06F 81/06
USPC ..... 4/570; 108/47, 48, 42, 26, 25, 152
See application file for complete search history.

(56) References Cited

U.S. PATENT DOCUMENTS 152,777 A * 7/1874 Strickler ..... D06F 81/06 108/97
348,462 A * 8/1886 Hall ..... A47B 13/16 108/25
2,721,777 A * 10/1955 Willis ..... B60N 3/001 108/44
2,791,476 A * 5/1957 Atwill ..... B60N 3/002 108/45
2,833,608 A * 5/1958 Tobias ..... B60N 3/001 108/44
3,566,882 A * 3/1971 Schroeder ..... A24F 19/10 131/234
4,893,363 A 1/1990 Huff
4,919,498 A * 4/1990 Turner ..... A47B 5/06 312/241
4,995,322 A * 2/1991 Frederick ..... A47B 5/06 108/38
5,370,060 A * 12/1994 Wang ..... B60N 3/004 108/149
5,528,993 A * 6/1996 Vincelli ..... A47B 5/06 108/48
5,722,329 A * 3/1998 Weng ..... A47B 5/00 108/152
5,893,331 A * 4/1999 Diletto ..... A47C 7/70 108/48
5,918,550 A * 7/1999 Weir ..... A47B 5/06 108/42
5,996,507 A * 12/1999 Joseph ..... B60N 3/001 108/125
6,321,662 B1 * 11/2001 Fraise ..... A47B 37/00 108/25
6,439,133 B1 * 8/2002 Jaramillo ..... A47B 1/08 108/25

(Continued)

*Primary Examiner* — Jose V Chen

(57) ABSTRACT

A poolside table apparatus for mounting to an above ground pool includes a tabletop having a tabletop top side, a tabletop bottom side, a tabletop front side, a tabletop back side, a tabletop left side, and a tabletop right side. The tabletop comprises a left section, a medial section, and a right section. The tabletop top side of the left section has a plurality of cupholder depressions to receive a plurality of cups and cans. The tabletop top side of the right section has a cooler aperture to receive a drink cooler. A plurality of clamps is coupled to the tabletop to selectively engage a rim of a pool. A pair of adjustable legs is coupled to the tabletop bottom side and has an adjustable leg height.

10 Claims, 7 Drawing Sheets

(56) References Cited

U.S. PATENT DOCUMENTS 6,474,244 B1 11/2002 Karpinski
6,729,685 B1 * 5/2004 Ebalobor ..... A47C 9/06 108/13
7,284,735 B1 * 10/2007 Khosropour ..... A47B 23/02 108/47
7,386,896 B2 * 6/2008 Spicer ..... E04H 4/14 220/23.4
7,966,948 B1 * 6/2011 Galietti ..... A47B 83/04 108/42
8,245,650 B1 * 8/2012 McKsymick ..... A47B 9/20 108/25
8,347,790 B1 * 1/2013 Maiers ..... A47B 13/16 108/26
8,365,716 B2 * 2/2013 Lin ..... A47J 37/0781 126/1 R
8,857,346 B2 * 10/2014 Khanjian ..... A47B 3/087 108/26
9,572,445 B2 2/2017 Weist
9,609,100 B2 * 3/2017 Litterello ..... H04M 1/11
9,629,450 B1 * 4/2017 Howard ..... A47K 17/02
9,814,305 B2 * 11/2017 Brus ..... E04H 17/14
10,117,513 B1 * 11/2018 Tolentino ..... A47B 13/16
10,130,166 B1 * 11/2018 Prokopovich ..... A47B 3/06
10,201,232 B2 * 2/2019 Melaragno ..... A47B 13/16
10,477,960 B1 * 11/2019 Johnson ..... A47B 3/002
D875,970 S * 2/2020 Heffernan ..... D25/68
10,612,304 B2 * 4/2020 Fischer ..... F16M 11/26
2001/0050033 A1 * 12/2001 Heimbrock ..... A61G 13/124 108/42
2002/0129746 A1 * 9/2002 Donnelly ..... A47B 21/00 108/25
2003/0000429 A1 * 1/2003 Ryburg ..... A47B 23/04 108/42
2004/0226486 A1 * 11/2004 Simpson ..... E04H 4/14 108/47
2006/0225624 A1 * 10/2006 Grace ..... A47B 3/04 108/26
2007/0101908 A1 * 5/2007 Makita ..... A47B 5/02 108/47
2009/0249982 A1 * 10/2009 Palethorpe ..... A47B 5/00 108/44
2009/0277358 A1 * 11/2009 Volpe, Jr ..... B60N 3/002 108/44
2012/0061411 A1 3/2012 Singh
2014/0102337 A1 * 4/2014 Ralph ..... A47B 3/00 108/25
2016/0183676 A1 * 6/2016 Limyansky ..... A47B 3/06 108/25
2017/0027314 A1 * 2/2017 Guzman ..... A47J 37/0786
2017/0042321 A1 * 2/2017 Clause ..... A47B 13/16
2018/0072208 A1 * 3/2018 Howe ..... A47B 5/04
2021/0100351 A1 * 4/2021 Thomas ..... A47B 3/08
2021/0153643 A1 * 5/2021 Haddy ..... A47B 5/04
2021/0274928 A1 * 9/2021 Hanks ..... A45C 13/30
2021/0345627 A1 * 11/2021 Gonzalez ..... A47B 5/04

* cited by examiner

POOLSIDE TABLE APPARATUS

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to pool furniture devices and more particularly pertains to a new pool furniture device for mounting to an above ground pool. The present invention includes a multi-section tabletop as well as a pair of adjustable legs for added support. A medial section of the tabletop is supported without clamps or legs.

(2) Description of Related Art Including Information Disclosed Under 37 CFR 1.97 and 1.98

The prior art relates to pool furniture devices. Existing devices clamp onto the side of a pool but lack adjustable legs which add further support from the ground. Known devices also lack a multi section tabletop with an unsupported medial section.

(h) BRIEF SUMMARY OF THE INVENTION

An embodiment of the disclosure meets the needs presented above by generally comprising a tabletop having a tabletop top side, a tabletop bottom side, a tabletop front side, a tabletop back side, a tabletop left side, and a tabletop right side. The tabletop comprises a left section, a medial section, and a right section. The medial section selectively engages an inner side of each of the left section and the right section. The tabletop top side of the left section has a plurality of cupholder depressions configured to receive a plurality of cups and cans. The tabletop top side of the right section has a cooler aperture configured to receive a drink cooler. A plurality of clamps is coupled to the tabletop. The plurality of clamps is configured to selectively engage a rim of a pool. A pair of adjustable legs is coupled to the tabletop. The pair of legs is coupled to the tabletop bottom side and has an adjustable leg height.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
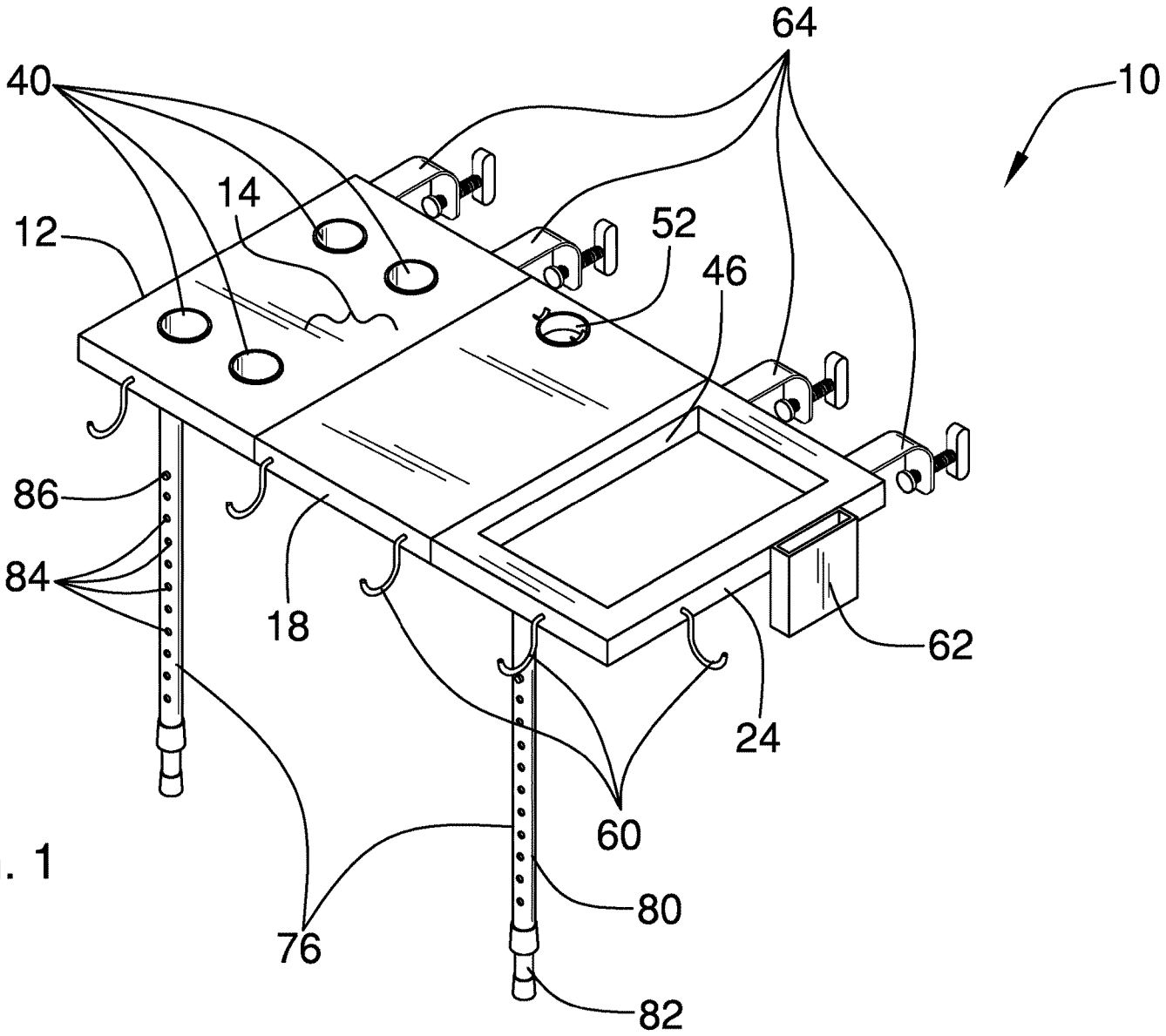
FIG. 1 is an isometric view of a poolside table apparatus according to an embodiment of the disclosure.
Figure 2:
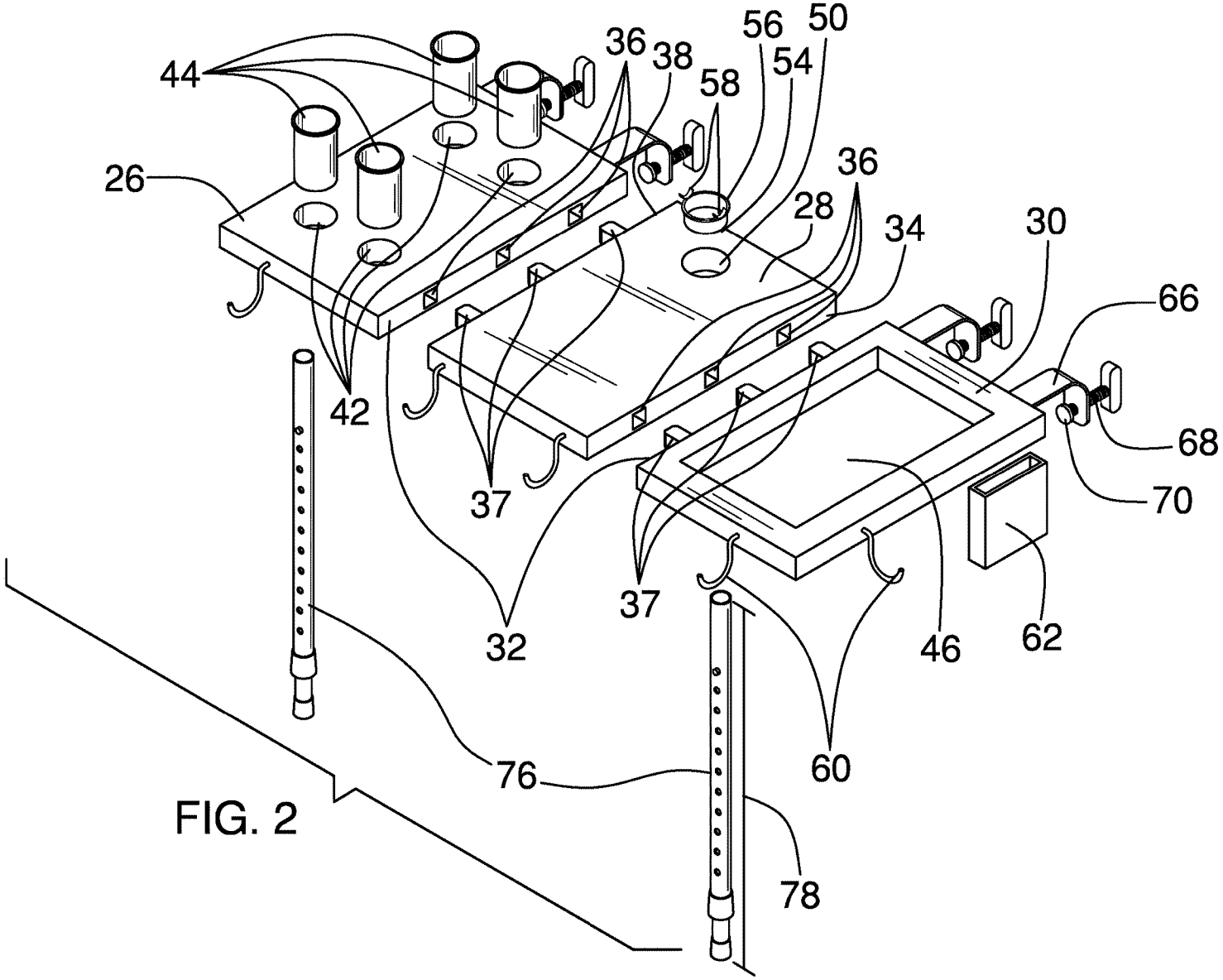
FIG. 2 is an exploded view of an embodiment of the disclosure.
Figure 3:
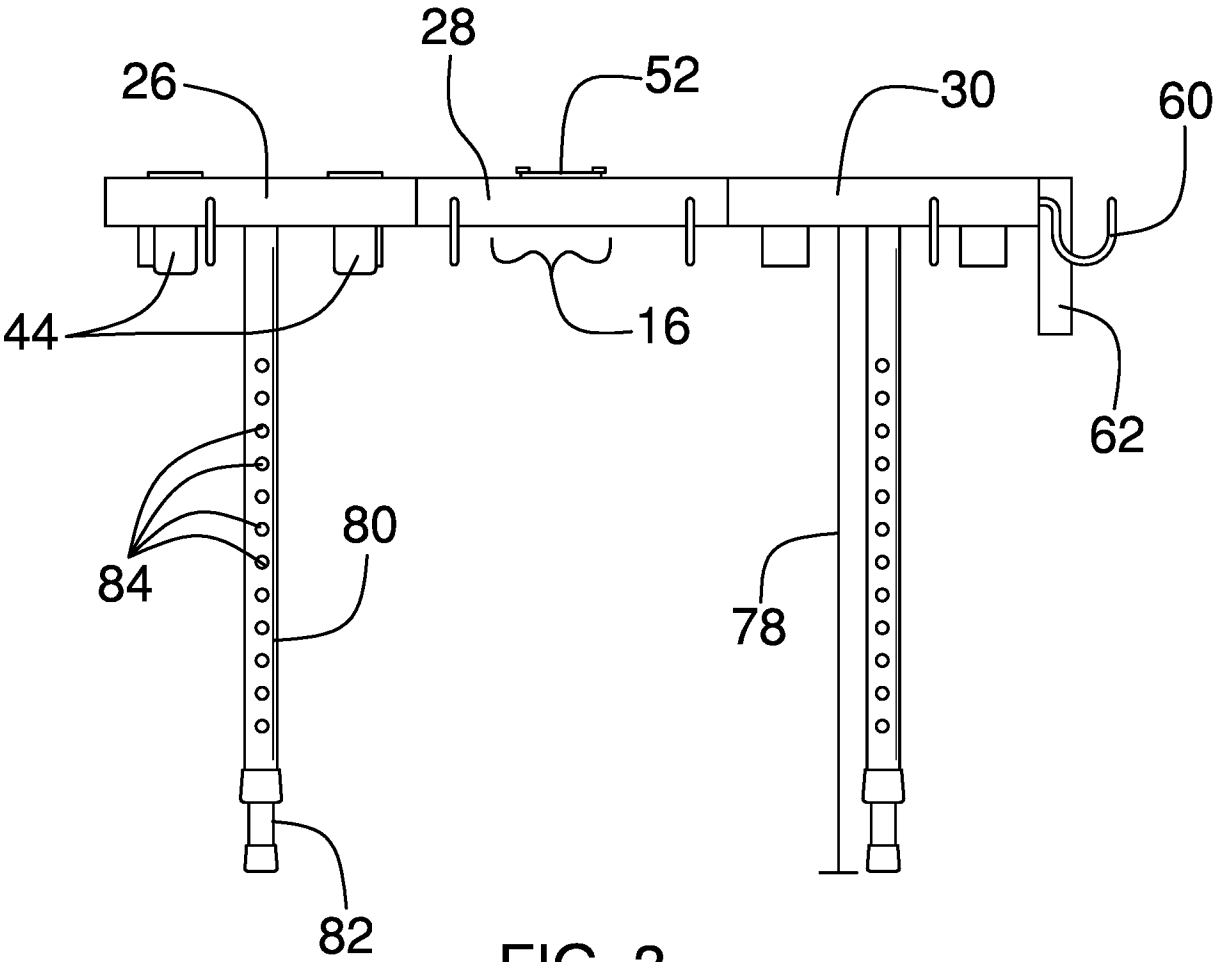
FIG. 3 is a front elevation view of an embodiment of the disclosure.
Figure 4:
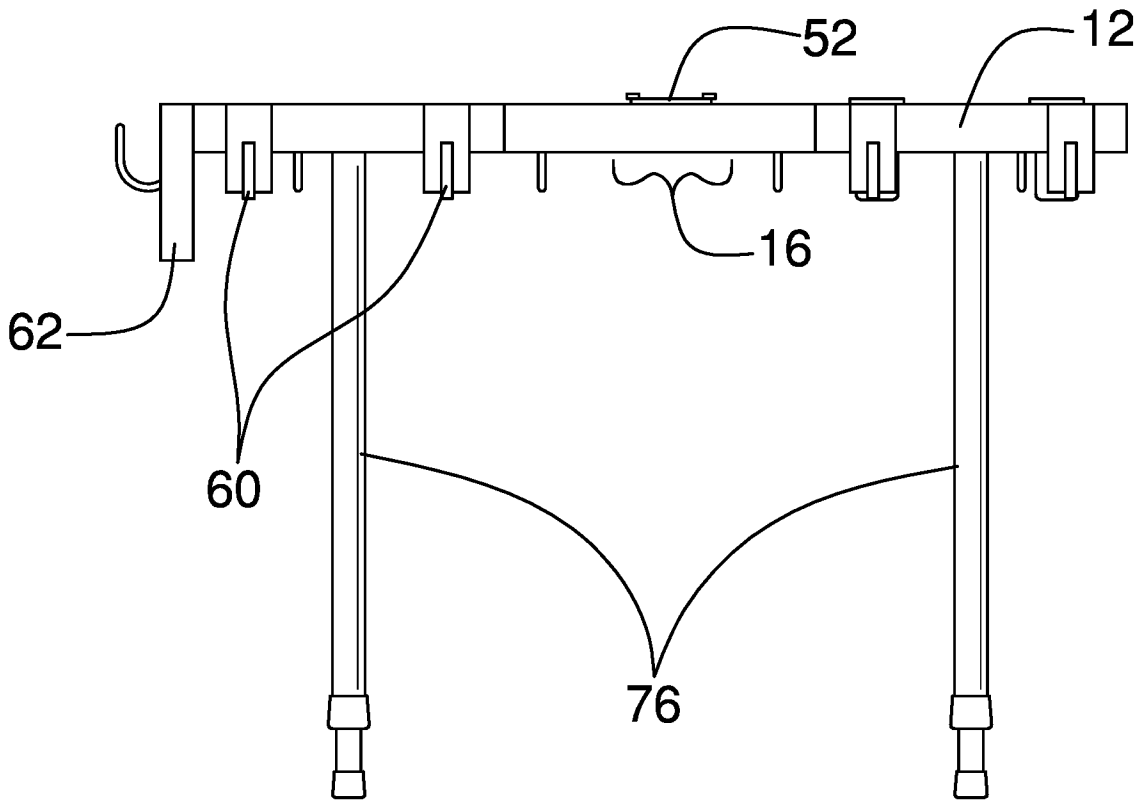
FIG. 4 is a rear elevation view of an embodiment of the disclosure.
Figure 5:
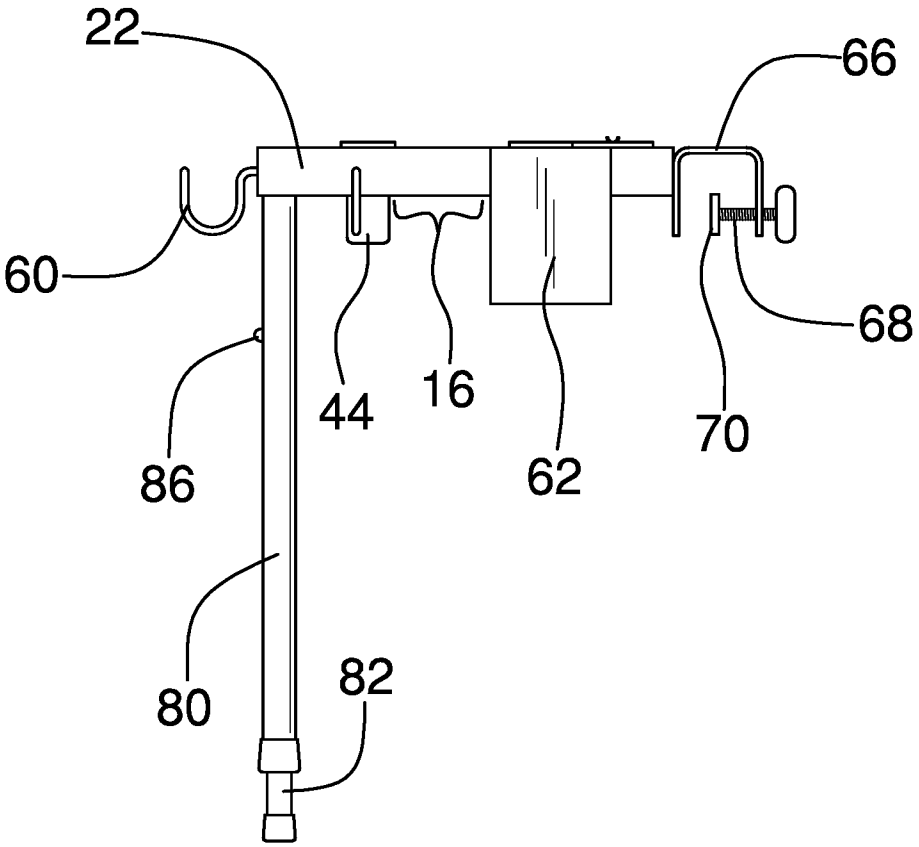
FIG. 5 is a side elevation view of an embodiment of the disclosure.
Figure 6:
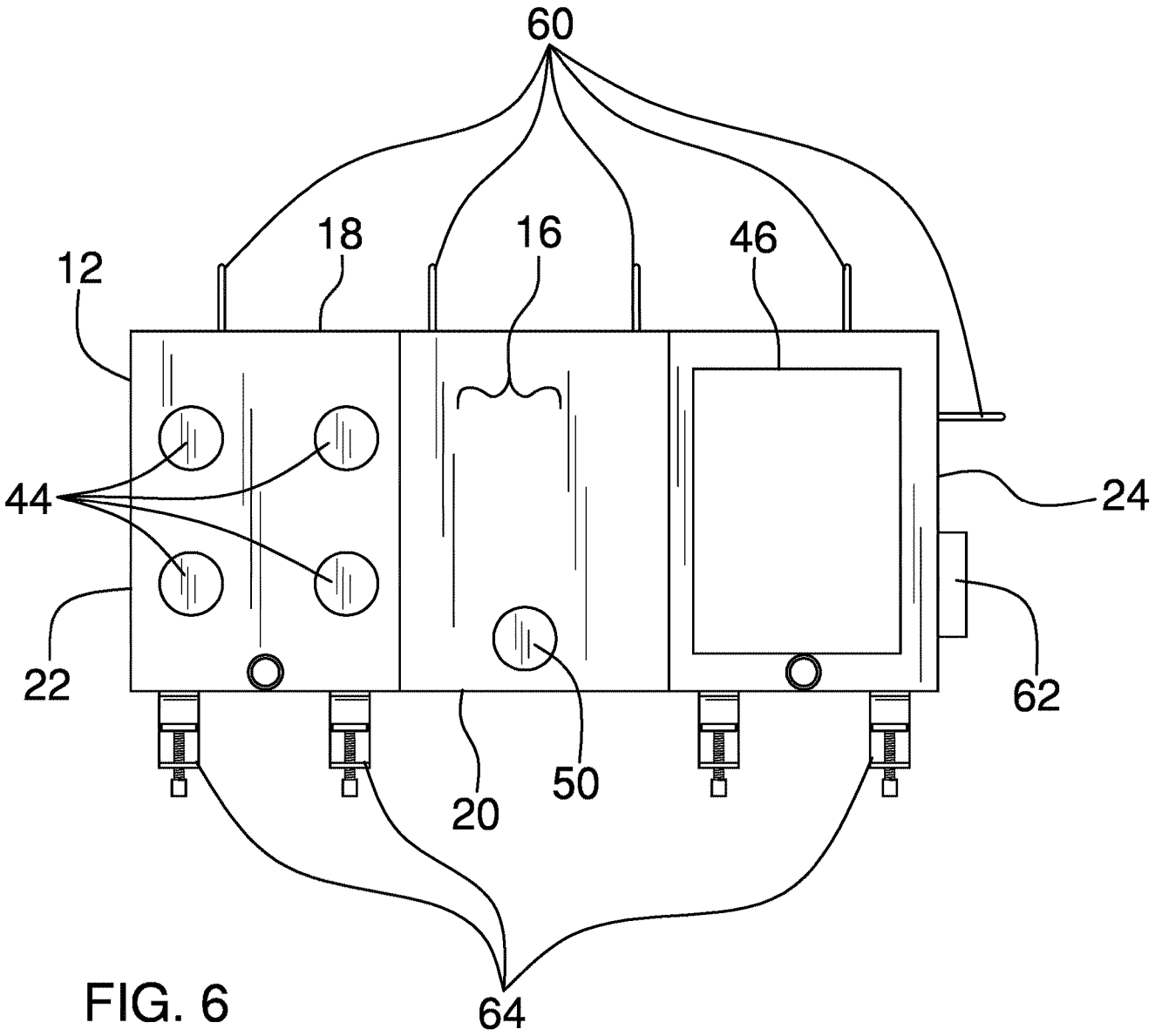
FIG. 6 is a bottom plan view of an embodiment of the disclosure.
Figure 7:
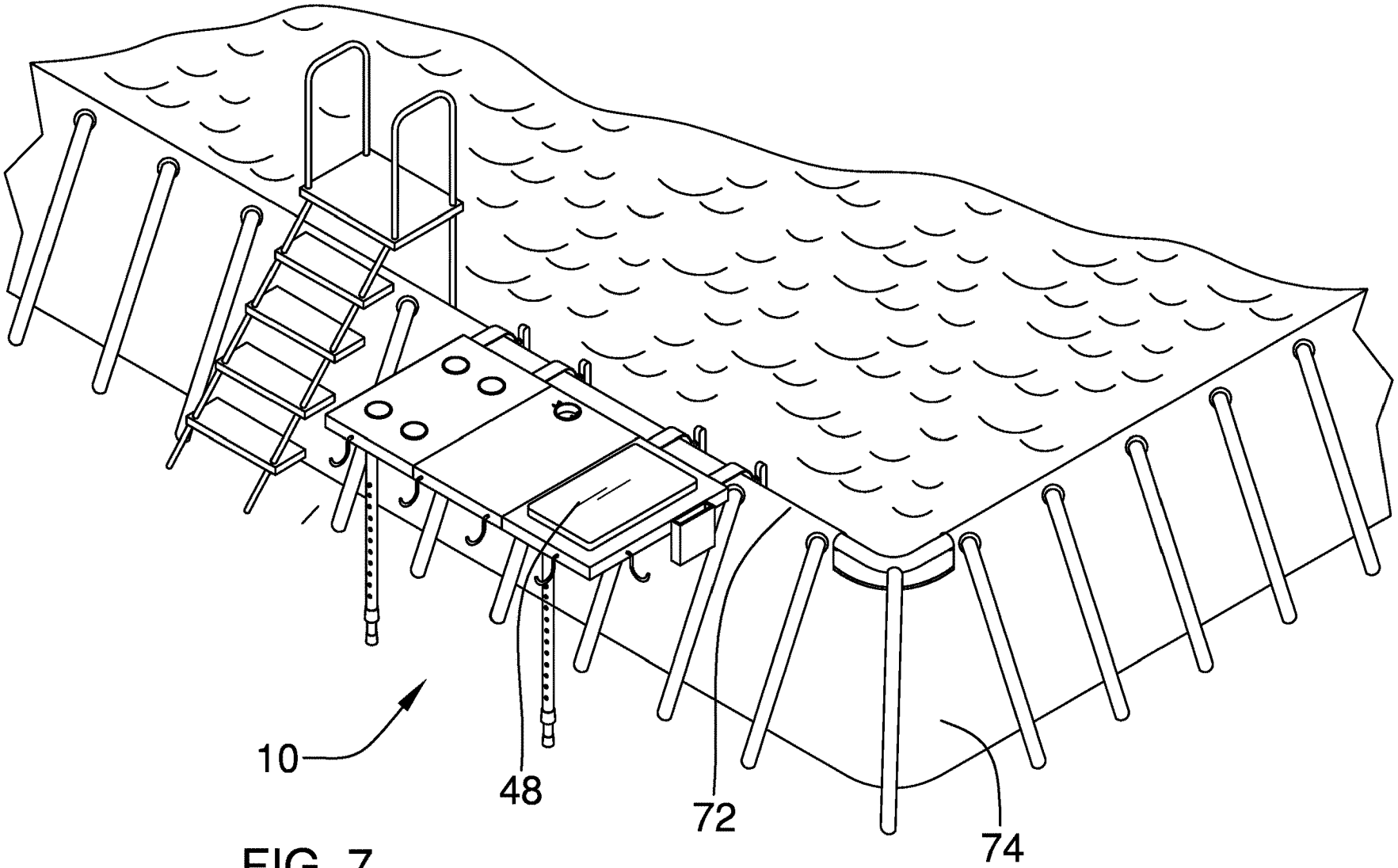
FIG. 7 is an in-use view of an embodiment of the disclosure.

With reference now to the drawings, and in particular to FIGS. 1 through 7 thereof, a new pool furniture device embodying the principles and concepts of an embodiment of the disclosure and generally designated by the reference numeral 10 will be described.

As best illustrated in FIGS. 1 through 7, the poolside table apparatus 10 generally comprises a tabletop 12 having a tabletop top side 14, a tabletop bottom side 16, a tabletop front side 18, a tabletop back side 20, a tabletop left side 22, and a tabletop right side 24. The tabletop 12 comprises a left section 26, a medial section 28, and a right section 30. The medial section 28 selectively engages an inner side 32 of each of the left section 26 and the right section 30. The inner side 32 of the left section and a medial right side 34 of the medial section may have a plurality of receiving cavities 36 to slidingly receive a plurality of protrusions 37 extending from a medial left side 38 of the medial section and the inner side 32 of the right section, respectively.

The tabletop top side 14 of the left section has a plurality of cupholder depressions 40 configured to receive a plurality of cups and cans. The plurality of cupholder depressions 40 may include a set of four cupholder apertures 42 with each cupholder aperture 42 slidingly receiving a cupholder 44. The tabletop top side 14 of the right section has a cooler aperture 46. The cooler aperture 46 is configured to receive a cooler 48.

The tabletop top side 14 of the medial section may have an ashtray cavity 50. An ashtray 52 is coupled to the tabletop 12. The ashtray 52 has a tray body 54 selectively engageable within the ashtray cavity 52 and a tray rim 56 resting on the tabletop top side 14. A pair of curved cigarette holders 58 may be coupled to the tray rim 56 and configured to support cigarettes and cigars.

A plurality of towel hooks 60 may be coupled to the tabletop 12. The plurality of towel hooks 60 is coupled to the tabletop front side 18, the tabletop left side 22, and the tabletop right side 24. Each towel hook 60 is configured to support a towel or robe. A phone pocket 62 may be coupled to the tabletop 12. The phone pocket 62 may be coupled to the tabletop right side 24 and is waterproof to safely store electronics.

A plurality of clamps 64 is coupled to the tabletop 12. The plurality of clamps 64 is coupled to the tabletop back side 20 of the left section and the right section. Each clamp 64 may include a clamp arm 66 protruding from the tabletop back side 20, a clamp screw 68 threadingly engaged with the clamp arm 66, and a clamp foot 70 coupled to the clamp screw 68. The clamp arm 66 may be U-shaped and configured to selectively engage a rim 72 of a pool 74.

A pair of adjustable legs 76 is coupled to the tabletop 12. The pair of legs 76 is coupled to the tabletop bottom side 16 and has an adjustable leg height 78. Each leg 76 includes an upper leg portion 80 coupled to the tabletop bottom side 16 and a lower leg portion 82 slidingly coupled within the upper leg portion 80. The upper leg portion 80 may have a plurality of adjustment apertures 84 and the lower leg portion 82 may have a spring button 86 to selectively engage the plurality of adjustment apertures 84.

In use, the plurality of clamps are engaged with the rim 72 of the pool. The pair of adjustable legs 76 are then adjusted to support the tabletop 12. Drinks may then be placed within the plurality of cupholders 44 and the cooler 48 may be set within the cooler aperture 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A poolside table apparatus comprising:

a tabletop having a tabletop top side, a tabletop bottom side, a tabletop front side, a tabletop back side, a tabletop left side, and a tabletop right side, the tabletop comprising a left section, a medial section, and a right section, each of the left section, right section, and medial section being separable from each other, the medial section selectively engaging an inner side of each of the left section and the right section to form the tabletop, the tabletop top side of the left section having a plurality of cupholder depressions configured to receive a plurality of cups and cans, the tabletop top side of the right section having a cooler aperture configured to receive a drink cooler;

a plurality of clamps coupled to the tabletop, the plurality of clamps being configured to selectively engage a rim of a pool, the plurality of clamps being coupled only to the tabletop back side of the left section and the right section; and a pair of legs coupled to the tabletop, the pair of legs being coupled to the tabletop bottom side of each of the left section and the right section respectively, each leg of the pair of legs having an adjustable leg height.

2. The poolside table apparatus of claim 1 further comprising a plurality of towel hooks coupled to the tabletop, the plurality of towel hooks being coupled to the tabletop front side, the tabletop left side, and the tabletop right side.

3. The poolside table apparatus of claim 1 further comprising a phone pocket coupled to the tabletop, the phone pocket being coupled to the tabletop right side.

4. The poolside table apparatus of claim 1 further comprising the tabletop top side of the medial section having an ashtray cavity; an ashtray being coupled to the tabletop the ashtray having a tray body selectively engageable within the ashtray cavity and a tray rim resting on the tabletop top side.

5. The poolside table apparatus of claim 1 further comprising the plurality of cupholder depressions being a set of four cupholder apertures, each cupholder aperture slidingly receiving a cupholder.

6. The poolside table apparatus of claim 1 further comprising each clamp including a clamp arm protruding from the tabletop back side, a clamp screw threadingly engaged with the clamp arm, and a clamp foot coupled to the clamp screw.

7. The poolside table apparatus of claim 6 further comprising the clamp arm being U-shaped.

8. The poolside table apparatus of claim 1 further comprising each leg including an upper leg portion coupled to the tabletop bottom side and a lower leg portion slidingly coupled within the upper leg portion.

9. The poolside table apparatus of claim 8 further comprising the upper leg portion having a plurality of adjustment apertures and the lower leg portion having a spring button to selectively engage the plurality of adjustment apertures.

10. A poolside table apparatus comprising:

a tabletop having a tabletop top side, a tabletop bottom side, a tabletop front side, a tabletop back side, a tabletop left side, and a tabletop right side, the tabletop comprising a left section, a medial section, and a right section, each of the left section, right section, and medial section being separable from each other, the medial section selectively engaging an inner side of each of the left section and the right section to form the tabletop, the tabletop top side of the left section having a plurality of cupholder depressions configured to receive a plurality of cups and cans, the plurality of cupholder depressions being a set of four cupholder apertures, each cupholder aperture slidingly receiving a cupholder, the tabletop top side of the right section having a cooler aperture configured to receive a drink cooler, the tabletop top side of the medial section having an ashtray cavity;

an ashtray being coupled to the tabletop the ashtray having a tray body selectively engageable within the ashtray cavity and a tray rim resting on the tabletop top side;

a plurality of towel hooks coupled to the tabletop, the plurality of towel hooks being coupled to the tabletop front side, the tabletop tell side, and the tabletop right side;

a phone pocket coupled to the tabletop, the phone pocket being coupled to the tabletop right side;

a plurality of clamps coupled to the tabletop, the plurality of clamps being coupled only to the tabletop back side of the left section and the right section, each clamp including a clamp arm protruding from the tabletop back side, a clamp screw threadingly engaged with the clamp arm, and a clamp foot coupled to the clamp screw, the clamp arm being U-shaped, the plurality of clamps being configured to selectively engage a rim of a pool; and a pair of adjustable legs coupled to the tabletop, the pair of legs being coupled to the tabletop bottom side of each of the left section and the right section respectively, each leg of the pair of legs having an adjustable leg height, each leg including an upper leg portion coupled to the tabletop bottom side and a lower leg portion slidingly coupled within the upper leg portion, the upper leg portion having a plurality of adjustment apertures and the lower leg portion having a spring button to selectively engage the plurality of adjustment apertures.

* * * * *